US008872055B2

(12) United States Patent
Reichle

(10) Patent No.: US 8,872,055 B2
(45) Date of Patent: Oct. 28, 2014

(54) NON-CONTACT RAIL HEATER WITH INSULATING SKIRT

(75) Inventor: David L. Reichle, Bradenton, FL (US)

(73) Assignee: Fastrax Industries, Inc., Littleton, CO (US)

( * ) Notice: Subject to any disclaimer, the term of this patent is extended or adjusted under 35 U.S.C. 154(b) by 69 days.

(21) Appl. No.: 13/444,656

(22) Filed: Apr. 11, 2012

(65) Prior Publication Data

US 2012/0261386 A1 Oct. 18, 2012

Related U.S. Application Data

(60) Provisional application No. 61/474,604, filed on Apr. 12, 2011.

(51) Int. Cl.

| | |
|---|---|
| ***B23K 9/067*** | (2006.01) |
| ***B23K 9/073*** | (2006.01) |
| ***H05B 1/00*** | (2006.01) |
| ***H05B 3/00*** | (2006.01) |
| ***H05B 7/00*** | (2006.01) |
| ***H05B 11/00*** | (2006.01) |
| ***B23H 1/06*** | (2006.01) |
| ***F27D 11/00*** | (2006.01) |
| ***H05B 3/68*** | (2006.01) |
| ***H05B 3/06*** | (2006.01) |
| ***B61B 7/00*** | (2006.01) |
| ***F16L 5/00*** | (2006.01) |
| ***E01B 7/24*** | (2006.01) |
| ***E01B 19/00*** | (2006.01) |

(52) U.S. Cl.

CPC .. *E01B 19/00* (2013.01); *E01B 7/24* (2013.01)
USPC ..... 219/50; 219/213; 219/69.15; 219/212; 219/385; 219/405; 219/406; 219/408; 219/443.1; 219/451.1; 219/454.11; 219/454.12; 219/460.1; 219/461.1; 219/468.1; 219/468.2; 219/481; 219/520; 219/542; 104/279; 104/280; 16/2.1; 16/16; 16/86.2

(58) Field of Classification Search

USPC ..... 219/213, 53; 104/279, 280; 246/428; 16/16, 86.2; 277/347, 355; 428/85
See application file for complete search history.

(56) References Cited

U.S. PATENT DOCUMENTS

| | | | | |
|---|---|---|---|---|
| 1,952,590 | A * | 3/1934 | Guenst | 104/279 |
| 2,090,156 | A * | 8/1937 | Scholz | 219/545 |
| 2,910,567 | A * | 10/1959 | Holstein | 219/213 |
| 3,233,097 | A | 2/1966 | Watkins | |
| 3,243,573 | A | 3/1966 | Weisse et al. | |
| 3,264,472 | A | 8/1966 | Simmons | |

(Continued)

*Primary Examiner* — Dana Ross
*Assistant Examiner* — Gyounghyun Bae
(74) *Attorney, Agent, or Firm* — Russell T. Manning; Marsh Fischmann & Breyfogle LLP

(57) ABSTRACT

A track rail heating assembly that is adapted to position a heater element in spaced relation proximate to a surface of a track rail of a railroad. The assembly includes at least one heating element, and a housing that is operable to at least partially surround the heating element while positioning the heating element near to track rail. The hood positions the heating element relative to the rail section such that a gap exists between the heating element and the rail section. As the heating element does not contact the rail, the heating element cannot form an electrical by-pass for signals passing through the rail section. The assembly further incorporates a flexible barrier that at least partially isolates a side surface of the track rail from ambient conditions to reduce heat loss.

16 Claims, 10 Drawing Sheets

(56) References Cited

U.S. PATENT DOCUMENTS

| | | | | | |
|---|---|---|---|---|---|
| 3,349,722 | A | | 10/1967 | Davis | |
| 3,394,251 | A | | 7/1968 | King et al. | |
| 3,439,161 | A | | 4/1969 | McElwee et al. | |
| 3,697,746 | A | | 10/1972 | Patterson et al. | |
| 4,024,004 | A | * | 5/1977 | Metzler | 156/169 |
| 4,195,805 | A | | 4/1980 | Keep, Jr. | |
| 4,260,105 | A | * | 4/1981 | Phillips | 238/303 |
| RE31,081 | E | | 11/1982 | Keep, Jr. | |
| 4,391,425 | A | * | 7/1983 | Keep, Jr. | 246/428 |
| 4,429,845 | A | * | 2/1984 | Stover et al. | 246/428 |
| 4,671,475 | A | | 6/1987 | Widmer | |
| 4,854,244 | A | * | 8/1989 | Rhodes et al. | 104/279 |
| 5,004,190 | A | | 4/1991 | Montierth et al. | |
| 5,249,654 | A | * | 10/1993 | Bruning | 191/22 DM |
| 5,348,257 | A | * | 9/1994 | Ocampo | 246/220 |
| 5,474,306 | A | * | 12/1995 | Bagepalli et al. | 277/355 |
| 5,622,340 | A | * | 4/1997 | Turner et al. | 246/415 R |
| 5,824,997 | A | * | 10/1998 | Reichle et al. | 219/537 |
| 5,845,881 | A | * | 12/1998 | Young et al. | 246/457 |
| 5,941,482 | A | * | 8/1999 | Santagata | 246/428 |
| 6,027,121 | A | * | 2/2000 | Cromer et al. | 277/347 |
| 6,065,721 | A | * | 5/2000 | Sumpton et al. | 246/428 |
| 6,104,010 | A | * | 8/2000 | Reichle et al. | 219/537 |
| 6,406,027 | B1 | * | 6/2002 | Aksit et al. | 277/355 |
| 6,727,470 | B2 | * | 4/2004 | Reichle | 219/213 |
| 7,168,662 | B1 | * | 1/2007 | McQuistian et al. | 246/449 |
| 7,387,280 | B2 | * | 6/2008 | Fritz et al. | 246/435 R |
| 7,513,335 | B2 | * | 4/2009 | Kumar | 184/3.2 |
| 7,775,008 | B2 | * | 8/2010 | King | 52/519 |
| 2003/0104161 | A1 | * | 6/2003 | Edwards | 428/85 |
| 2005/0172439 | A1 | * | 8/2005 | Weihrauch | 15/187 |
| 2010/0084390 | A1 | * | 4/2010 | Ohlsson et al. | 219/213 |
| 2010/0163543 | A1 | * | 7/2010 | Reichle | 219/213 |
| 2011/0253844 | A1 | * | 10/2011 | Ferryman et al. | 246/428 |

* cited by examiner

NON-CONTACT RAIL HEATER WITH INSULATING SKIRT

CROSS-REFERENCE TO RELATED APPLICATION

This application claims the benefit of the filing date of U.S. Provisional Application No. 61/474,604 entitled: "NON-CONTACT RAIL HEATER WITH INSULATING SKIRT" having a filing date of 12 Apr. 2011, the entire contents of which are incorporated herein by reference.

FIELD

The presented inventions relate to railroad track heaters which can be mounted proximate to a surface of a track rail to provide radiative and/or convective heating.

BACKGROUND

Railtrack heaters are often utilized on areas of track rails where it is desirable that the track be devoid of snow, ice and/or moisture. One such area is around sensors (e.g., infrared sensors) that are mounted relative to track rails to detect hot boxes on passing trains. A hot box occurs when the bearings between an axle and wheel (i.e., the box) of a particular train car heat to an excessive temperature that may allow the bearings to fail. Hot boxes present a fire hazard and can lead to the fracturing of the axle and possibly train derailment. Where an infrared sensor monitors a hot box on a passing train, a train engineer may receive a signal originating from the sensor indicating the need to take corrective action. However, if such a sensor is covered with snow or ice or, for example, develops a fogged lens, the sensor may not function for its intended purpose.

Another area where it is desirable to reduce or eliminate snow build up is around railroad track switches. In order to ensure proper functioning of a railroad track switch, it is important that the switching rail (e.g., tapered movable rail, point blade) and stationary rail make good contact when in an engaged position. Accordingly, in cold climates, it is common to heat the rail switch or otherwise guard against buildup of ice or snow at the switch, especially at the interface between the gauge side of the stationary rail and field side of the switching rail. Furthermore, it is also common to heat railroad frogs (e.g., movable point frogs, stationary frogs) as the buildup of ice and/or snow could otherwise inhibit a train wheel from properly crossing over a rail at a rail junction. Malfunctioning of the switch due to such build up presents a danger of derailment potentially resulting in personal injury and/or property damage.

Typically, railroad track heaters provide conductive heat to the rails by being directly mounted and in contact with the rails. One such heater is described in U.S. Pat. No. 5,824,997, the content of which is incorporated herein by reference. Generally, such heaters include a metal jacket that is mounted directly to a rail to maximize thermal conductivity between the heater and the rail.

SUMMARY

Railtrack rails are often subjected to stresses and dynamic overloads that can cause internal faults in the rail, such as oval flaws, horizontal, transverse or longitudinal cracks, star-shaped cracks, breaks in track joints, etc. Because of the inherent danger in a train utilizing a track with such faults, it is important to be able to detect such faults on the track using a non-destructive method. Ideally, rails in a track section with faults can be replaced before the faults become critical.

One method of detecting rail faults involves the use of low voltage signals that are transmitted through the rails at various intervals, each interval essentially functioning as a circuit. For example, at each interval, a low voltage source is connected in series with a current sensor and a resistor to both of the rails. The current sensor will initially record current readings in a situation known to have no breaks or faults in the rail to determine a baseline current reading. Thereafter, if the current sensor measures a significant and sustained deviation in current in an interval, the rails of that specific interval can be inspected for faults or other interruptions. Generally, a break or interruption in the rail leads to increased resistance or an open circuit resulting in a decreased or open current reading for that interval.

One concern that has been recognized is that if a fault or interruption occurs on a portion of the rail coincident with a railroad track heater that is in direct contact with the rail, a current drop in this portion may be reduced. That is, as such heaters typically include electrically conductive metal jackets, there is some concern that such heaters may carry electrical signals that are intended to pass through the rails. Stated otherwise, there is some concern that signals intended to pass through the rail may potentially by-pass a break or fault in the rail and pass through the electrically conductive heater. As a result, the sensor might not record any significant current decrease and the fault or other interruption may go unnoticed. While not typically a concern in applications such as track switch heating where other electrical by-passes typically exist, such by-pass is of concern in running rail applications that handle higher speed traffic.

It is one object of the presented inventions to provide non-contact railroad track heater systems that allows for heating a section of a rail without providing an electrical by-pass around that rail section.

It is another object of the presented inventions to at least partially confine convective and radiant heat, generated by a heater, relative to a specific portion of a track rail.

According to various aspects, a non-contact rail heater is provided that is adapted to provide heat to a rail section without providing an electrical by-pass or otherwise disrupting electrical signals passing through the rail section. The heater includes at least one heating element for transferring heat to a rail section and a housing that is adapted to maintain the heater element proximate to a surface of a track rail. In one arrangement the housing positions the heating element relative to the rail section such that a gap exists between the heating element and the rail section. Stated otherwise, the heater element may be mounted such that no portion of the element is in contact with the track rail. As will be appreciated, as the heating element does not contact the rail, the heating element cannot form an electrical by-pass for signals passing through the rail section. In addition to positioning the heater element, the housing may partially surround the heating element to reduce heat losses to the ambient environment. In one arrangement, the housing and supported heater element are suspended above a foot portion of the track rail to, for example, facilitate placement of the heater about track rail protrusions (e.g., attachment clamps etc.). In such an arrangement, the heater element maybe disposed proximate to the rail head. The heater may further include a flexible barrier or skirt that extends between the housing and the foot portion of the rail when the housing is suspended. This flexible skirt may fit over and/or around rail protrusions and act to shield the track rail (e.g., web and/or foot) from ambient weather and reduce heat loss through the rail. Stated otherwise, the flexible skirt may provide a barrier for a portion of the entirety of a side of the track rail.

Any type of housing may be used that operates to at least partially shield the heater element from weather elements (e.g., snow, rain, wind) while the heater element is situated between the housing and a track rail. In one arrangement, the housing is formed as a recessed element that receives the heater element. Such a recessed or channel member may include a recessed surface that is adapted to face the track rail. In one arrangement, the heater element is at least partially disposed within a recessed surface of the channel member. In further embodiments, end caps may be appropriately mounted to the ends of the housing to further isolate an interior of the housing from the ambient environment. The housing may also be of any appropriate dimensions and constructed of any appropriate materials. For instance, the housing may be constructed of electrically non-conductive and/or insulative materials.

According to another aspect, a rail heating apparatus is provided for heating a portion of a track rail. The apparatus includes an elongated housing having at least one surface adapted for disposition proximate to a length of a track rail. The housing supports an elongated heater element, which is typically attached to a rail-side surface of the elongated housing. One or more support elements support the elongated housing and heater element above a foot portion of the track rail. A flexible skirt member is attached to at least a portion of the length of the elongated housing. This skirt member extends from housing to a position proximate to either the foot of the track rail or a support surface underlying the track rail (i.e., when the housing is supported approximate to the track rail).

In one arrangement, the skirt is formed of a continuous, flexible member that extends along the length of the housing. In another arrangement, the flexible skirt member is non-continuous. In such an arrangement, the skirt may be formed of a plurality of adjacent flap members that may flex free of adjacent flap members. In another arrangement, the flexible skirt member is formed of a brush member having a plurality of individual filaments or bristles. In such an arrangement, the individual filaments may have a diameter between about 0.002 inches and about 0.01 inches.

In one arrangement, at least a portion of the housing is formed of an electrically insulating material. For instance, the edge of the housing member that is adapted for disposition proximate to (e.g., against) the track rail may be an electrically insulating material that may prevent electrical conduction through the heater assembly. In such an arrangement, the housing may support the heater element in a fixed space relationship from the surface of the track rail to prevent electrical conduction through the heater element.

DETAILED DESCRIPTION

Figure 1:
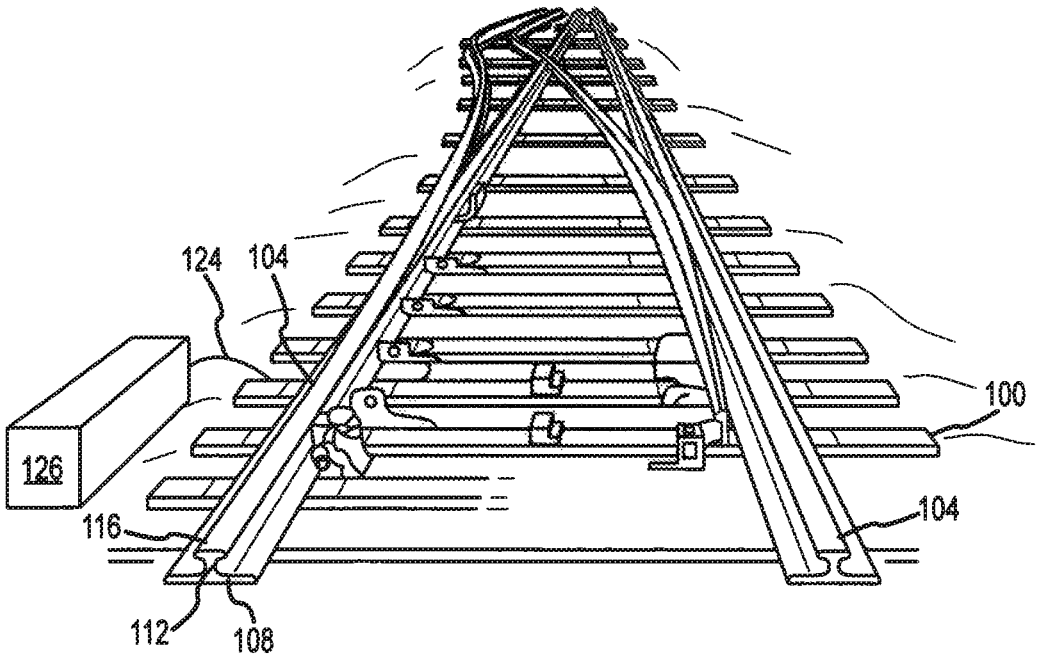
FIG. 1 is a perspective view of a conventional railroad track.

FIG. 1 illustrates a conventional railroad track at a switching location. The track includes at least two track rails 104 mounted on a plurality of support ties 100. Each track rail 104 includes a mounting flange or foot 108 that rests on the plurality of support ties 100, a head portion 116 including a wheel bearing surface, and a web portion 112 interconnecting the foot 108 and the rail head 116. The web portion 112 includes a gauge (inner) side and an opposite field (outer) side.

Figure 2B:
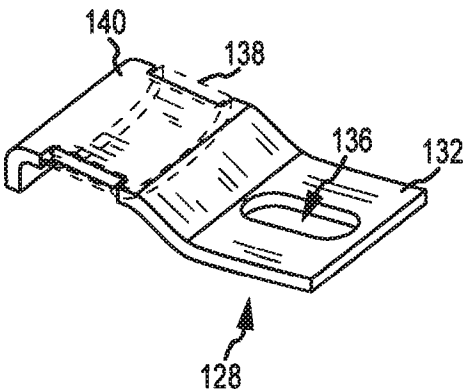
FIG.2B (PRIOR ART)
FIG. 2B is a perspective view of a clamp for affixing the heater of FIG. 2A directly to a track rail.
Figure 2A:
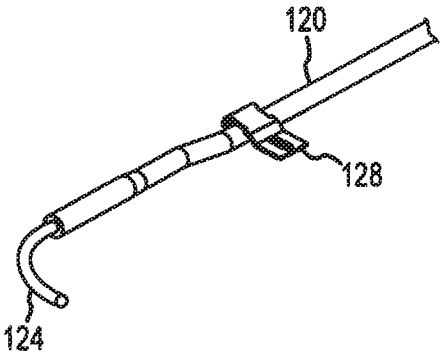
FIG.2A (PRIOR ART)
FIG. 2A is a perspective view of an exemplary track heater.

At such switching locations in cold climates a track heater (not shown) is mounted to the field side of the track rail. As shown in FIG. 2A, the track heater 120 may include an electrical line 124 that connects the heater 120 to a utilities outlet 126 (See FIG. 1), generator or other power source to provide power to the heater. While the track heater 120 is typically mounted to the field side of the track rail 104, those of ordinary skill in the art will appreciate that the track heater can be mounted anywhere it is necessary to have an area substantially devoid of snow, ice or other forms of precipitation, such as on the gauge side of the rail near a track switch, frog structure, switching rail, hotbox detector, etc. The track heater 120 may be appropriately associated with temperature controls (e.g., thermostats, thermistors) to allow an operator or other user to select a desired temperature and/or radiant heat output of the track heater 120.

FIG. 2A illustrates one methodology for mounting the track heater 120 directly to a surface a track rail. As shown, one or more mounting brackets 128 may be disposed along the length of the track heater 120 to affix the track heater to the rail. As shown in FIG. 2B, each mounting bracket 128 includes a first portion 132 for removably attaching (e.g., bolting) the mounting bracket 128 to a track rail 104, and a second portion 140 for removably mounting the track heater 120 to the track rail 104. The first portion 132 may include at least one bore 136 for accepting any appropriate fastener (not shown) to attach the first portion 132 to the field side of the track rail 104. The second portion 140 may be in the form of a generally curved member that may define a concave space facing towards the track rail 104 and sized to receive the track heater 120. In one arrangement, a spring clip 138 is positioned within the concave space for urging the track heater 120 against the rail 104 when the bracket is secured to the rail. Such a mounting bracket and heater element are disclosed in U.S. Pat. No. 6,104,010 the contents of which are incorporated herein by reference. Generally, any mounting bracket connecting a rail heater to a rail maintains the metallic sheath/jacket of the track heater in direct contact with the track rail. Though not illustrated to scale, it will be appreciated that such track heaters may be of considerable length. For instance, some track rail heaters exceed 36 feet in length.

Track rails are often monitored for breaks or faults using electrical signals that pass through the track rails. If a monitored signal in a particular rail section changes or becomes open, it can be an indication that there is a break or fault in that section of track rail. One concern is that if such a break or fault occurs between the ends of a track heater having an electrically conductive jacket in contact with a track rail, the signals may potentially by-pass the fault and be conducted through the track heater. Accordingly, in various non-limiting embodiments a rail heating assembly is provided that eliminates the ability of track carried signals by-passing breaks or faults through the track heater.

Figure 3:
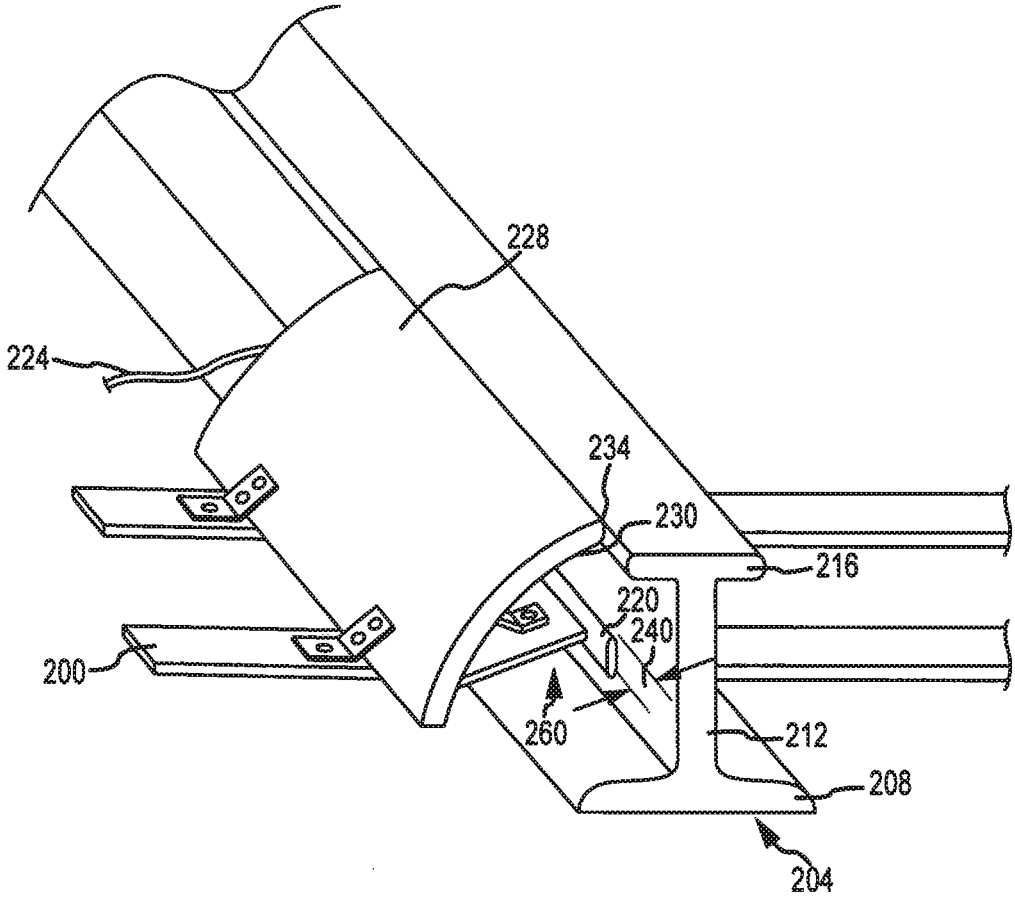
FIG. 3 is a perspective view of the track heater assembly according to one embodiment of the present invention.
Figure 4:
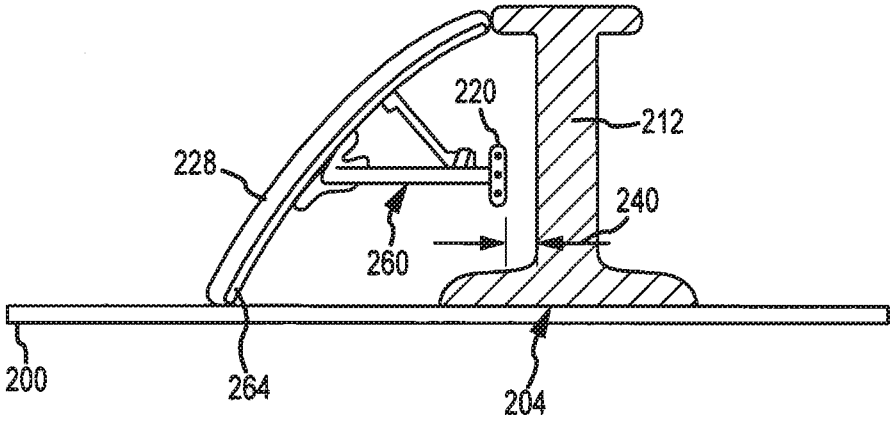
FIG. 4 is a sectional view along the line 4-4 of FIG. 3.

With reference to FIGS. 3-4, one embodiment of an assembly for heating a rail section of a railroad track is illustrated. The track includes at least two track rails 204 (only one being shown) mounted on a plurality of support ties 200. Each track rail 204 includes a mounting flange/foot 208 that rests on the plurality of support ties 200, a rail head 216 including a wheel bearing surface, and a web portion 212 interconnecting the mounting flange 208 and the rail head 216. The web portion 212 includes a gauge side and a field side.

Mounted in a spaced relationship from a field side of the track rail is a heater element 220. The heater element 220 may include at least one electrical line 224 that connects the heater element 220 to a utilities outlet, generator or other power source to provide power to the heater. The electrical line 224 typically includes two or more conducting wires, which are encased in any appropriate sheathing. The heater element 220 is mounted by an arrangement that maintains the element in the fixed spaced relationship to the surface of the track rail. That is, the mounting arrangement maintains a space or gap 240 between the track heater 220 and the track rail 204. The space or gap 240 between the heater element and any conductive portions of the rail reduces the likelihood of an electrical bypass around a break or fault in the track rail 204 passing through the heater element.

With continued reference to FIGS. 3-4, the arrangement broadly includes a housing member 228, the heater element 220 and a mounting arrangement 260 that mounts the track heater 220 to the housing member 228 in a position proximate to and spaced from the surface of the track rail 204. The housing member 228 supports the heater element 220 and concentrates heat from the heater on the track rail 204. That is, as the heater element 220 is not in direct contact with the track rail, heat transfer from the heater 220 to the rail is via radiative transfer and convective transfer rather than conductive transfer. If the heater element were substantially exposed to the ambient environment, much of the heat generated by the heater assembly could be lost as opposed to being absorbed by the track rail 204. For instance, if unprotected wind may carry much of the heat away before being absorbed into the track rail.

In the illustrated embodiment, the housing member is configured as a self-supporting housing that extends from a portion of the track rail (e.g., rail head 216) to the underlying support ties 200. The length of the housing may be varied to accommodate heaters of differing lengths. The housing member and track rail collectively define an at least partially enclosed volume or interior/inside surface (i.e., between the rail and the housing member) for housing the heater element(s) 240. Further, the housing member will usually include endplates/caps at both ends to further isolate the heater 220 within the inside surface from the ambient environment. Stated otherwise, the housing member 228, when disposed against the rail 204, provides a substantially enclosed volume that helps isolate the heater 220 and the heat generated by the heater.

The design of the housing member 228 also prevents electrical by-pass around a break or fault in the track rail 204. That is, at least the portion of the housing member 220 that contacts the rail is constructed of an electrically non-conductive material. Such materials include, without limitation, woods and fiberglass. Although not shown, front edge 234 of the housing member 228 may be provided with at least one bumper (e.g., rubber, plastic) to prevent damage to either the housing member 228 or the rail head 216. Moreover, the bumper can provide shock or vibration absorbing properties to isolate the heater element from track rail vibrations and prevent damage from accruing to the heater element 220. In the present embodiment, the housing member 228 is a curved member having a recessed inside surface 230 (e.g., concave). In this regard, the housing member 228 may facilitate the drainage of moisture (e.g., rain, snow) away from the housing member and ultimately the heater element 220. In other embodiments, the housing member 228 may be in the form of multiple planar/plate members and/or a singular plate member that may be adapted to extend linearly from a portion of the track rail 204 (e.g., rail head 216) to the support ties 200.

Continuing to refer to FIGS. 3-4, a heater mounting arrangement 260 is shown. While one embodiment of the heater mounting arrangement 260 is illustrated, those of ordinary skill in the art will appreciate that any mounting arrangement can be utilized that suspends the heater element proximate to a desired surface of the track rail. In the present embodiment, the heater mounting arrangement 260 is the form of a bracket assembly that include at least one cantilever member having a forward end that is adapted to support the heater element 220 at a distance spaced from the foot or web portion 212 of the track rail 204.

The housing member 228 may further include an optional radiative shield or lining 264 mounted inside of the housing member to enhance the heating effect of the heater element 220 on the track rail 204 by radiating heat emitted by the heater element 220 back onto the track rail 204. For instance, the lining 264 may include any appropriate reflective coating (e.g., paint, metal lining, etc.) having a high emissivity to reflect radiant heat onto the rail 204. As the track 204 is typically constructed of a material having a low emissivity (e.g., dark, dull materials), the track rail 204 may readily absorb radiant heat from the heater element 220 as well as radiant heat reflected from the lining 264. It will be appreciated that such a shield or lining may also protect the housing member 228 from heat produced by the heater element 220 in addition to isolating heat generated by the heater element 220 within the housing member 228.

Figure 5:
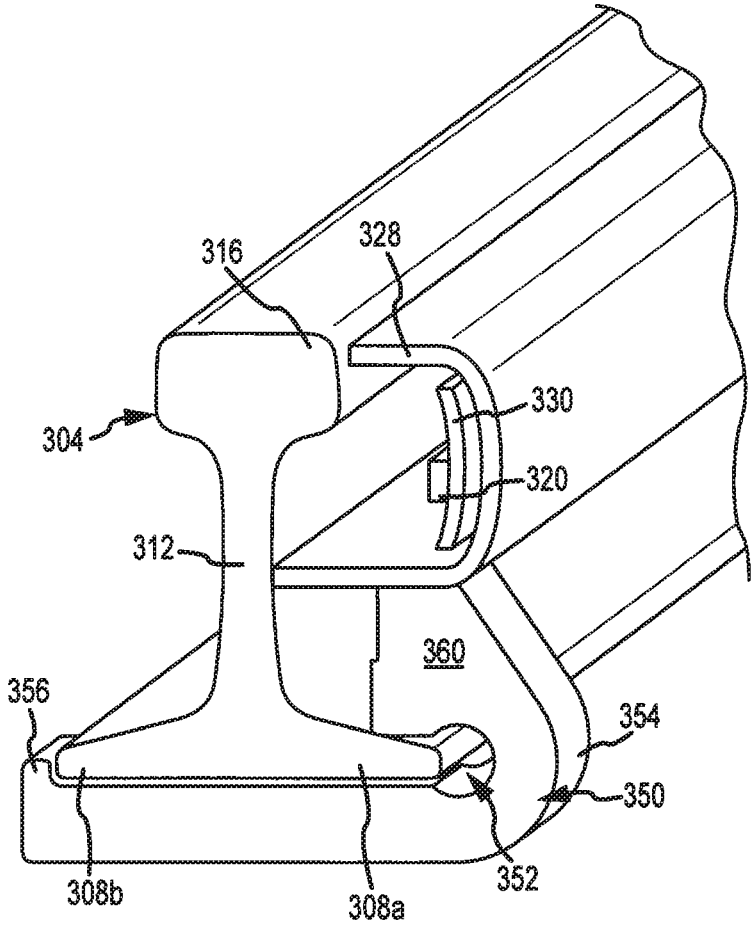
FIG. 5 is a cross-sectional view of a track heater assembly according to another embodiment of the present invention.

Referring to FIG. 5, another embodiment of a track heater assembly is shown. As shown, a recessed housing member 328 provides an at least partially enclosed interior for housing a heater element 320. Though shown as being substantially U-shaped along its cross-sectional profile, it will be appreciated that the housing member may have any recessed shape that allows for engaging first and second surfaces of a track rail to provide an at least partially enclosed housing for a heater element. Generally, the housing member 328 is an elongated member the length of which may be chosen to accommodate the length of a particular heater element. In addition, end plates or caps (not shown) may be provided to cover the open ends of the housing member. This may reduce convective heat loss to the ambient environment. In the present embodiment, an upper portion of the housing member 328 is adapted to engage the head flange 316 of the track rail 304 and a lower portion of the housing member 328 is adapted to engage a web portion 312 of the track rail 304. That is, a first contact surface contacts the head flange and a second contact surface contacts the web. Accordingly, this may require that the housing member be suspended above the foot of track rail.

As may be appreciated, the foot/flanges 308 of a track rail are commonly interconnected to underlying ties utilizing periodically spaced spikes, tie plates and/or clamps. Irrespective of the exact mechanism that interconnects the track rail to the underlying ties, the attachment mechanism often protrudes above the top surfaces of the flanges. Accordingly, the protrusion of these attachment mechanisms may complicate positioning of a housing or housing member relative to the track rail. Suspension of the housing member 328 above the foot/flange 308 of the track rail may simplify positioning of the housing member 328 and heater element 320 relative to the track rail. That is, the lower edge of the housing member 328 may be spaced above the top of the flange 308 such that the heater assembly is disposed above the attachment mechanisms that hold the track rail relative to underlying ties. It will be appreciated that the suspended housing member 328 may be differently configured to engage different portions of the track rail.

As above, the housing member 328 may include a mounting arrangement that maintains a fixed gap or spacing between the heater element 320 and the track rail 304. As previously described, the gap eliminates contact between the heater and the track rail 304 and thereby prevents the potential of any electrical bypass of signals carried by the track rail 304 through the heater. The present embodiment further includes a reflector/radiative shield 330 that is disposed between the closed end of the housing member 328 and that heater 320.

One or more mounts or attachment devices 350 are used to secure the housing member 328 relative to the track rail. Typically, at least first and second attachment devices may be spaced along the length of the housing member to provide support. In the illustrated embodiment, the attachment device is a wrap-around spring clamp/anchor that supports the housing member. This anchor 350 is a wraparound anchor that extends across the bottom of the track rail 304 to engage the both flanges 308*a*, 308*b* of the track rail 304. The wraparound anchor may be applied to the track rail by disposing a flange into a receiving slot 352 and striking the end 359 of the anchor 350. This has the effect of driving the flange 308*a* into slot 352 such that a flange tab 356 may extend over the end of the opposing flange 308*b*. The wraparound anchor also incorporates a support 360 that engages a lower surface of the housing member 328 and correctly positions the housing member relative to the track rail. It will be appreciated that various clamps or anchors may be utilized to suspend the housing member relative to the track rail. A non-limiting set of such clamps/anchors are set forth in U.S. Patent Publication No. 2006/0032934 entitled: "Non-invasive railroad attachment mechanism" the contents of which are incorporated by reference herein. Another rail clamp is set forth in U.S. Publication No. 2008/0257973 entitled: "Railroad Signal Line Attachment Clip" the contents of which are incorporated by reference herein.

As noted above, the foot/flange of a track rail is commonly interconnected to underlying ties utilizing periodically spaced spikes, plates and/or spring clamps. See e.g., FIG. 6. In addition to such rail attachment mechanisms 360, junction splice bars 390 are commonly bolted to one or both sides of the webs of abutting track rails. The junction splice bars may themselves include one or more braces 392, which further protrude from the rail surface. The protrusion of these and additional elements from the track rail surface complicates the positioning of a heater assembly relative to the track rail. One option to overcome such positioning difficulties is to suspend a heater element above the rail foot and proximate to the rail head of the track rail, which is typically devoid of attached structures. While suspending a heating assembly proximate to the rail head and above the foot of the track rail alleviates some positioning difficulties, such positioning may leave most or the entirety of the side surface of the track rail exposed to ambient conditions and thereby allow for the rapid dissipation of heat from the track rail 304.

FIGS. 7-10 illustrate additional embodiments of heater assemblies that may provide non-contact heating for a track rail and which further facilitate positioning of the heater assembly relative to a track rail while reducing ambient heat loss. More specifically, the heater assemblies provide a heater element that may be suspended proximate to a rail head in conjunction with a flexible barrier that may cover the side surface of a track rail even in instances where the surface of the track rail includes various protrusions.

Figure 7:
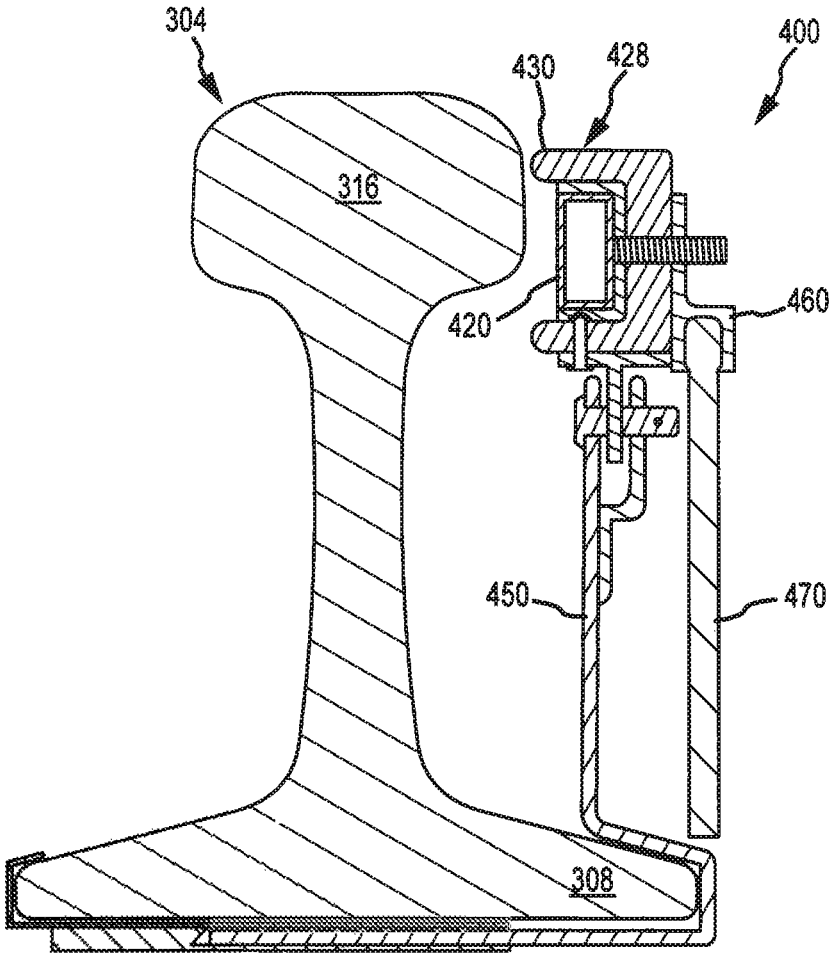
FIG. 7 illustrates a cross-sectional view of another embodiment of a track heater assembly.

FIG. 7 illustrates a cross-sectional end view of one non-limiting embodiment of a flexible barrier heater assembly 400. A shown, the assembly 400 utilizes a housing 428 having a first edge 430 that is adapted for positioning proximate to the head portion 316 of the track rail 304. Typically, at least this first edge of the housing is an insulating material to prevent electrical contact with the track rail 304. Further, the entirety of the housing may be an insulating material. In the illustrated embodiment, the housing 428 is formed of a U-shaped channel member having an inside recessed surface (e.g., rail-side recess) that is sized to receive an elongated heater element 420. While being illustrated as U-shaped member, it will be appreciated that housing 428 may be shaped in any manner that partially isolates the heater element relative to the track rail. For example, and without limitation, the housing may be an L-shaped bracket, curved member (e.g. half or quarter round) or even a flat plate member. What is important is that the housing supports the heater element and at least partially shields the heater element from the ambient environment to direct heat toward the track rail. The assembly 400 also utilizes one or more supports 450 that suspend the housing 410 and the heater element 420 proximate to the rail head 316. These supports 450 may be selectively positioned along the length of the housing 410. Accordingly, the supports 450 may be spaced to prevent interference with structures protruding from the surface of the track rail.

In the present embodiment, a bracket 460 is interconnected to an outside surface of the housing 428. This bracket supports a flexible barrier or skirt 470, which as illustrated extends from the housing 428 proximate to an upper surface of the foot 308 of the track rail. However, it will be appreciated that the flexible skirt 470 may be attached to the housing any appropriate means. Though illustrated as extending to the top surface of the foot 308 of the track rail, it will be appreciated in other embodiments that the length of the flexible skirt 470 may be selected to extend to beyond the foot of the track rail to, for example, a support surface underlying the track rail. The flexible skirt 470 may be formed of any durable and pliable material that may be disposed over and/or around various protrusions on the surface of the track rail. Such materials include, without limitation, fabrics, rubberized materials, synthetic materials (e.g., nylon) and natural materials. While the skirt member 470 may be made of any appropriate materials, it may be desirable that these materials withstand high temperatures and prolonged exposure to ambient conditions (e.g., UV light, freezing and thawing, etc.). In the former regard, it will be appreciated that the heater element may heat the housing and the skirt to several hundred degrees Fahrenheit.

Figure 6:
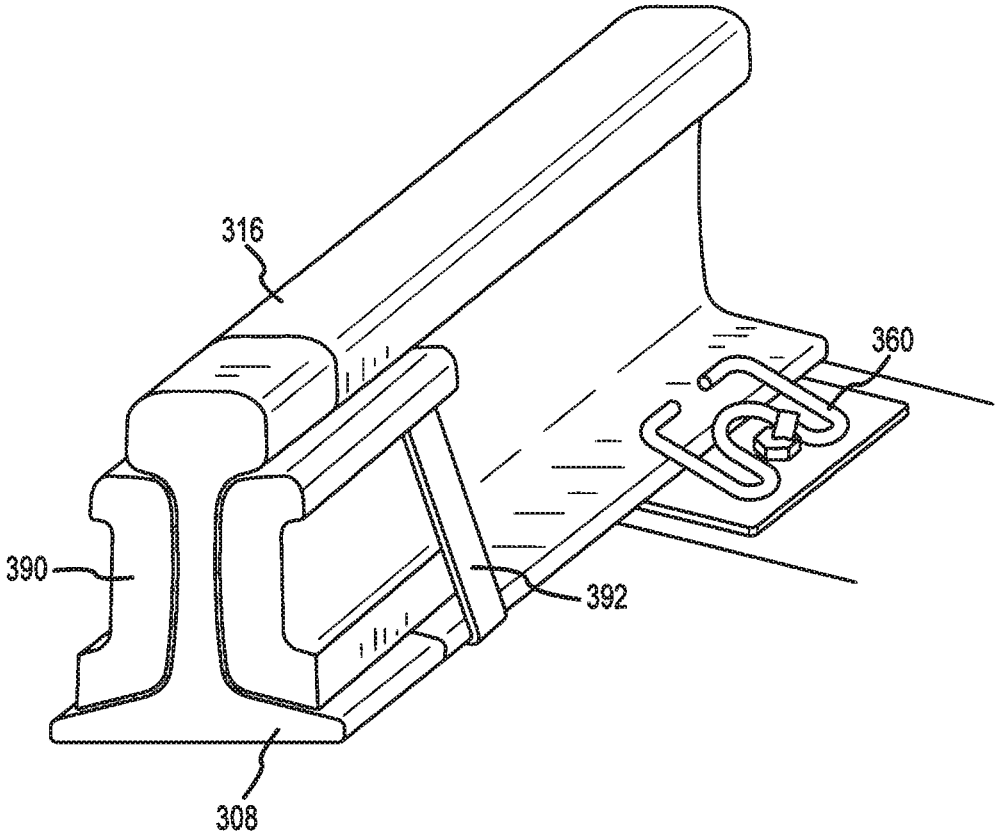
FIG. 6 illustrates elements attached to the surface of a track rail.
Figure 8:
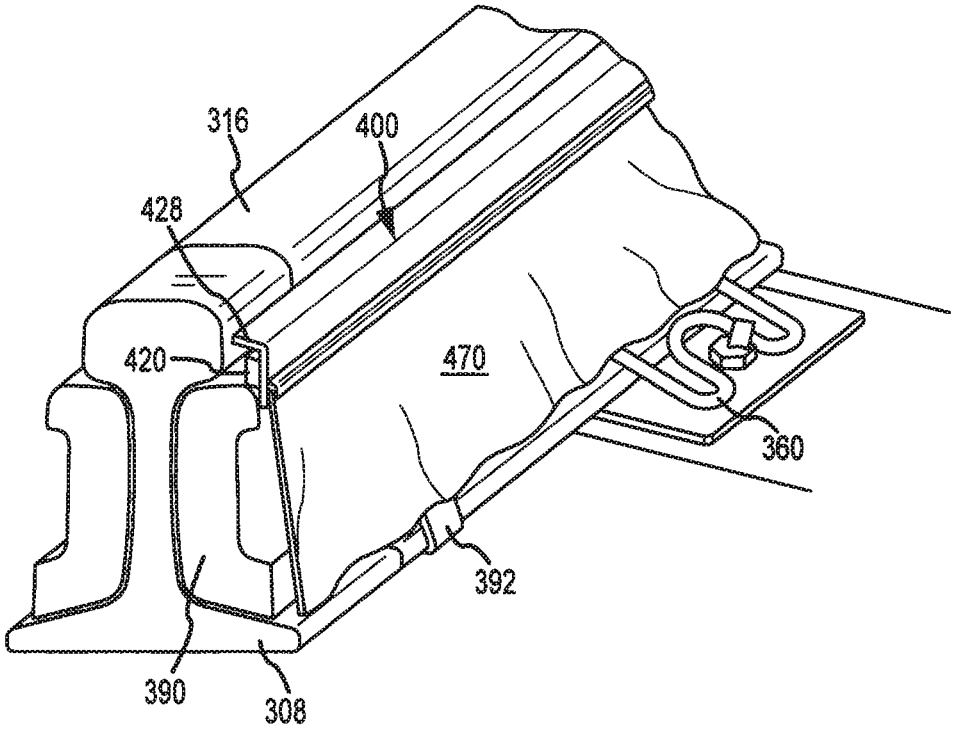
FIG. 8 illustrates a first embodiment of the track heater assembly of FIG. 7 as applied to the track rail of FIG. 6.
Figure 9:
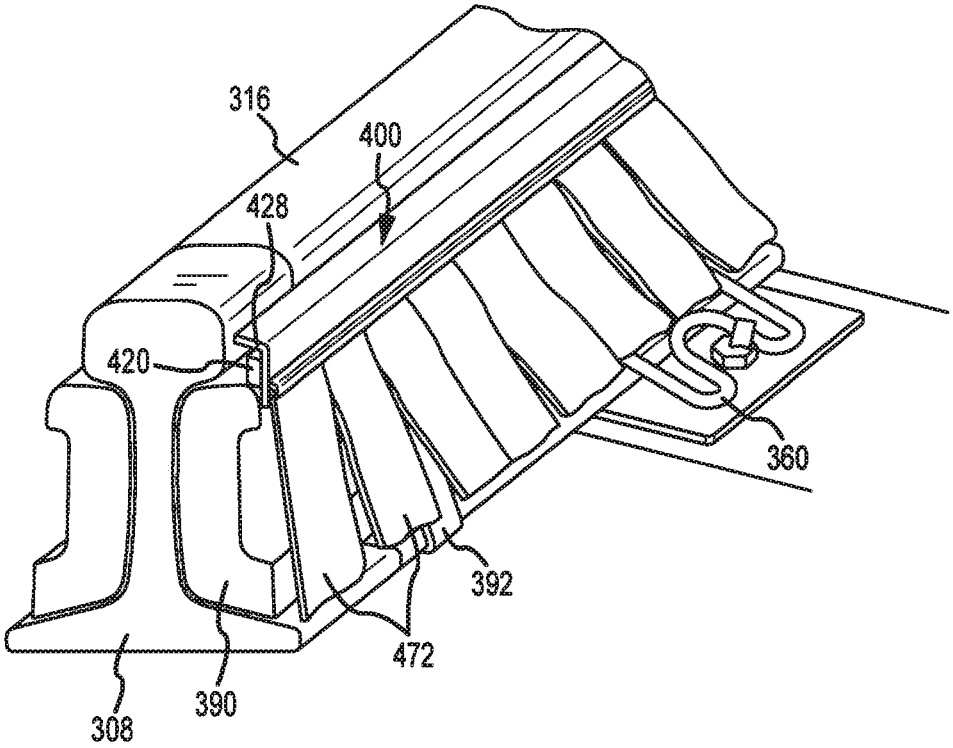
FIG. 9 illustrates a second embodiment of the track heater assembly of FIG. 7 as applied to the track rail of FIG. 6.
Figure 10:
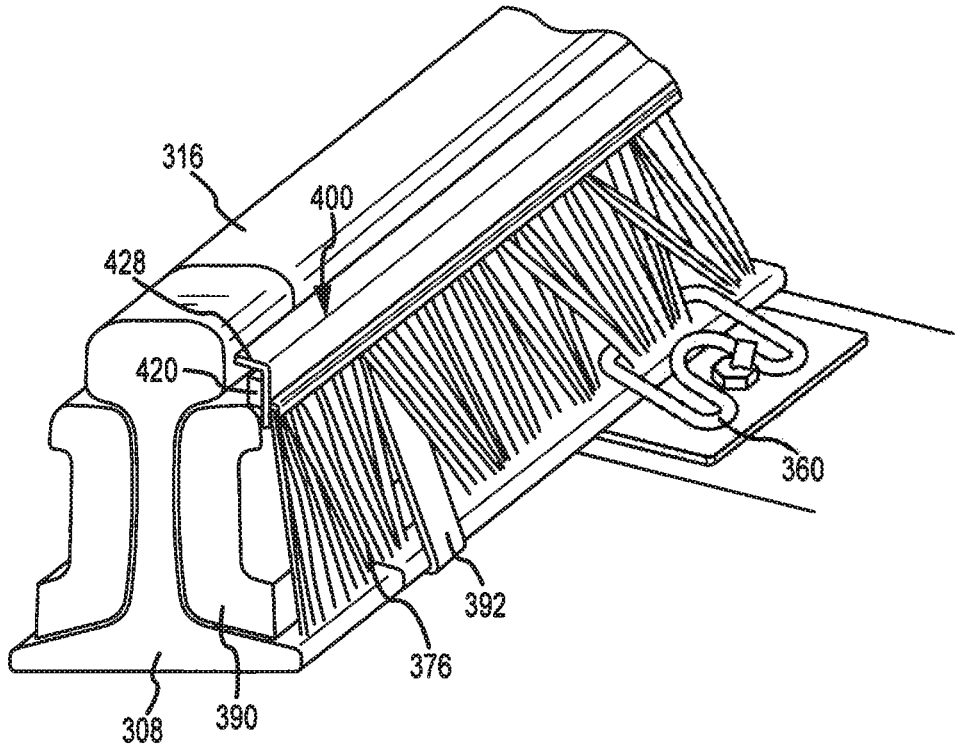
FIG. 10 illustrates a third embodiment of the track heater assembly of FIG. 7 as applied to the track rail of FIG. 6.

FIG. 8 illustrates a first embodiment of the heater assembly 400 as applied to the track rail illustrated in FIG. 6. As shown, this embodiment of the heater assembly 400 utilizes a skirt 470 that is continuous along the length of the housing 428 and which drapes over components protruding above the surface of the track rail, e.g., splice bars 390, brace 392 and attachment mechanisms 360. FIG. 9 illustrates a further embodiment of the heater assembly 400. In this embodiment a plurality of individual flaps 472 define the flexible barrier/skirt. That is, rather than utilizing a continuous skirt interconnected along the length of the housing 428, this embodiment utilizes a plurality of individual flaps 472 that are disposed adjacent to one another along the length of the housing 428. In this regard, the individual flaps 472 may deflect free of deflection of an adjacent flap. Use of such a discontinuous barrier may facilitate placement of the skirt about protrusions from the rail.

In another embodiment, the flexible skirt is formed of a brush 376 having a plurality of individual bristles. See FIG. 10. As shown, these bristles extend between the housing 428 and the foot 308 of the track rail. These individual bristles are flexible enough to allow for their disposition over and around various structures interconnected to the track rail. While being positioned about different components interconnected to the track rail, it will be appreciated that the number and density of the bristles are such that the brush provides a significant barrier between the outside surface of the track rail and the ambient environment. That is, the bristles provide significant isolation from the elements reducing the amount of heat that is carried away by, for example, wind.

As previously described, the housing of the presented inventions may be constructed of a non-conductive material so as to not provide an electrical bypass around any faults or breaks in the track rails. For instance, the housings may be constructed of fiberglass, ceramics, polymers, etc. Additionally, the housing could be constructed of a thermally insulative but electrically non-conductive material. Such a material avoids an electrical bypass while containing heat generated by the heater element thus increasing the effectiveness of the track heater. For instance, the housing members could be constructed of various polymeric materials, composites, etc. Likewise, the surfaces of the housing member may be insulated. Moreover, to avoid heat losses from wind, ambient air or other weather elements passing through the housings and carrying off heat generated by the track heaters, any of the housing of the present invention can include closed or angled ends to prevent such heat losses from such weather elements.

While each of the track heaters of the various embodiments of the present invention is shown as being mounted near the field side of the track rail, those of ordinary skill in the art will appreciate that the heater element can be mounted anywhere it is necessary to have an area substantially devoid of snow, ice or other forms of precipitation, such as near a track switch, frog structure, switching rail, hotbox detector, other critical moving parts, etc. Additionally, the heater element could be mounted on the gauge side or other location near a track rail. Accordingly, the various assemblies presented herein can be modified to fit such other locations.

Any of the features previously described with respect to particular embodiments may be utilized in conjunction with other embodiments. For instance, bumpers, reflective linings and/or additional track heaters may be appropriately used with embodiments other than embodiments those that such features were described with herein. The above described embodiments, while including the preferred embodiment and the best mode of the invention known to the inventor at the time of filing are given as illustrative examples only. It will be readily appreciated that many deviations may be made from the specific embodiments disclosed in the specification without departing from the spirit and scope of the invention. Accordingly, the scope of the invention is to be determined by the claims below rather than being limited to the specifically described embodiments above.

The invention claimed is:

1. A rail heating apparatus for heating a portion of a track rail, comprising:

an elongated channel member having recessed surface adapted to face a length of a track rail, the channel member having at least one edge of the recessed surface adapted for disposition proximate to a length of said track rail, an elongated electrical heater element, wherein the elongated heater is attached within the recessed surface of the channel member, wherein the channel member suspends the elongated heater element proximate to said length of said track rail and out of contact from a surface of said track rail when said channel member is supported proximate to said track rail;

a least a first support element adapted to support the channel member and the elongated heater element above a foot portion of said track rail;

a flexible skirt member attached to at least a portion of a length of the channel member wherein the skirt member extends from the channel member to a position proximate to at least one of said foot portion of said track rail and a support surface underlying said track rail when the channel member is supported proximate to said track rail.

2. The apparatus of claim 1, wherein the channel member supports the elongated heater element in a fixed spaced relationship to said track rail when the at least one edge is positioned proximate to the track rail.

3. The apparatus of claim 1, wherein when the channel member is positioned proximate to said track rail the channel member supports the elongated heating element relative to said track rail to maintain a gap between the elongated heater element and said track rail.

4. The apparatus of claim 1, wherein the flexible skirt member comprises:

a brush member having a plurality of individual filaments.

5. The apparatus of claim 4, wherein the individual filaments have a diameter between 0.002 inches and 0.01 inches.

6. The apparatus of claim 4, wherein the filaments comprise a synthetic material.

7. The apparatus of claim 4, wherein the filaments have a melting point of at least 350° F.

8. The apparatus of claim 1, wherein the first support element is adapted to attach to said foot of said track rail.

9. The apparatus of claim 1, wherein the first support element comprises a clamp having first and second opposing surfaces adapted to compress a portion of said track rail there between.

10. The apparatus of claim 1, wherein at least the first edge of the housing is formed of an electrically insulating material.

11. A rail heating apparatus for heating a portion of a track rail:

at least one elongated heating element;

a channel member having a first edge adapted for disposition against a length of a head portion of a track rail, wherein the elongated heating element is at least partially secured in a recess of the channel member such that the channel member supports the elongated heater element in a fixed spaced relationship to said track rail, wherein the heater element is suspended away from a surface of said track rail when the first edge is positioned proximate to said head portion of said track rail; and a brush skirt attached to at least a portion of the length of the channel member, wherein the brush skirt includes a plurality of individual filaments that extend from the channel member to a position proximate to at least one of a foot portion of said track rail and a support surface underlying said track rail when the channel member is disposed supported proximate to said head portion of said track rail.

12. The apparatus of claim 11, wherein the filaments comprise a synthetic material.

13. The apparatus of claim 11, wherein the filaments have a melting point of at least 350° F.

14. The apparatus of claim 11, wherein at least the first edge of the channel member is formed of an electrically insulating material.

15. The apparatus of claim 11, further comprising at a least a first support element adapted to support the channel member above said foot portion of said track rail.

16. The apparatus of claim 15, wherein the first support element comprises a clamp having first and second opposing surfaces adapted to compress a portion of said track rail there between.

* * * * *